US006273964B1

(12) United States Patent
Fortunati et al.

(10) Patent No.: US 6,273,964 B1
(45) Date of Patent: Aug. 14, 2001

(54) PROCESS FOR THE PRODUCTION OF GRAIN ORIENTED ELECTRICAL STEEL STRIP STARTING FROM THIN SLABS

(75) Inventors: Stefano Fortunati, Ardea; Stefano Cicale', Rome; Giuseppe Abbruzzese, Montecastrilli, all of (IT)

(73) Assignee: Acciali Speciali Terni S.p.A., Terni (IT)

( * ) Notice: Subject to any disclaimer, the term of this patent is extended or adjusted under 35 U.S.C. 154(b) by 0 days.

(21) Appl. No.: 09/242,992

(22) PCT Filed: Jul. 24, 1997

(86) PCT No.: PCT/EP97/04010

§ 371 Date: Feb. 26, 1999

§ 102(e) Date: Feb. 26, 1999

(87) PCT Pub. No.: WO98/10104

PCT Pub. Date: Mar. 12, 1998

(30) Foreign Application Priority Data

Sep. 5, 1996 (IT) ..... RM96A0606

(51) Int. Cl.[7] ..... C21D 8/12

(52) U.S. Cl. ..... 148/111; 148/112; 148/230; 148/541; 164/476; 164/477; 164/478

(58) Field of Search ..... 148/307, 111, 148/112, 230; 164/541, 476, 477, 478

(56) References Cited

FOREIGN PATENT DOCUMENTS

4311151 * 7/1994 (DE) .
391335 * 10/1990 (EP) .
659503 * 6/1995 (EP) .
2130241 * 5/1984 (GB) .

OTHER PUBLICATIONS

Patent Abstracts of Japan, vol. 097, No. 001, Publication No. 08225843, Publication Date Sep. 3, 1996, Jan. 31, 1997.*

* cited by examiner

*Primary Examiner*—Deborah Yee
(74) *Attorney, Agent, or Firm*—Hedman & Costigan, P.C.

(57) ABSTRACT

In the production of grain oriented electrical steel sheet, controlling the condition of thin slab continuous casting results in advantageous solidification structures and precipitates. The steel has an initial content of carbon less than 300 ppm and an initial content of acid-soluble aluminum higher than that normally used for said type of steel. During the final processing steps, the annealed sheet is nitrided through a limited amount of nitrogen. This, in turn, renders the process for controlling the grain dimensions much less critical and results in a constant quality product.

16 Claims, 3 Drawing Sheets

PROCESS FOR THE PRODUCTION OF GRAIN ORIENTED ELECTRICAL STEEL STRIP STARTING FROM THIN SLABS

FIELD OF THE INVENTION

The present invention refers to a process for the production of grain oriented electrical steel strip starting from thin slabs, and more precisely refers to a simplified process for the production of grain oriented electrical steel which provides a consistent and superior quality product.

STATE OF THE ART

Grain oriented electrical silicon steel is generically classified into two main categories, essentially differing in relevant induction value measured under the effect of an 800 As/m magnetic field, called B800 value; the conventional grain oriented product has a B800 lower than about 1890 mT, while the high-permeability product has a B800 higher than 1900 mT. Further subdivisions are made considering the core losses value, expressed in W/kg at given induction and frequency.

Said products have essentially the same field of application, mainly for the production of transformer cores. The high-permeability, oriented grain steel finds application in those fields in which the advantage of high permeability and low core losses can compensate for its higher cost relative to conventional products.

The grain orientation of electrical steel strips is obtained by finely precipitated second phases in a one of the last production steps which is known as secondary recrystallization. During secondary recrystallization, the growth of the grains or crystals of iron (body centered cube) are inhibited up to a certain temperature, beyond which, in a complex process, the crystals having an edge parallel to the rolling direction and a diagonal plane parallel to the strip surface (Goss structure), selectively grow.

The second phases, i.e. non-metallic precipitates within the solidified steel matrix, which are utilized to obtain the growth inhibition are mainly sulfide, and/or selenides, particularly of manganese, for the conventional oriented grain steels and nitrides, particularly containing aluminum, for the high-permeability oriented grain steels.

The intrinsic complexity of the oriented grain electrical steel production process is essentially attributable to the fact that said second phases precipitate in coarse form, during the relatively slow cooling of the continuously cast slab. The coarse form is useless for providing the desired effect in oriented grain steel product. For the desired effect, the coarse grains must be dissolved and reprecipitated in the proper form which must be maintained up to the moment during the final secondary recrystallization step when the grain is obtained which has the desired dimensions and orientation.

From the above, the following idea can be derived, that a quicker cooling during the continuous casting should improve the inclusional state of the slabs, thus rendering less complex the control of the various steps of the slab transformation process into strips. However, it was found that the thin slab continuous casting though having a cooling rate quite higher than the one obtainable in the conventional continuous casting, is not sufficient per se to allow obtaining the necessary quality.

This applicant has extensively studied the possibility of utilizing the technologies of thin slab or continuous strip casting, which has been utilized extensively for carbon steels and for more sophisticated steels such as silicon electrical steels. In this field, good results were obtained with conventional oriented grain and in one of the high magnetic characteristics of oriented grain steels.

DESCRIPTION OF THE INVENTION

The present invention aims to improve the conventional grain oriented electrical steel production, utilizing in an innovative way the thin slab continuous casting technology and introducing specific modifications of the transformation process.

In particular, the continuous casting process is carried out in such a way that a particular equiaxic to columnar grains ratio is obtained, as well as specific equiaxic grains dimensions and precipitates of limited dimensions.

The present invention refers to a silicon steel strip production process of the kind above identified as conventional, in which a silicon steel is continuously cast, high-temperature annealed, hot rolled, cold rolled in a single step or in a plurality of steps with intermediate annealings, the cold rolled strip so obtained is annealed to perform primary annealing and decarburization, coated with annealing separator and box annealed for the final secondary recrystallization treatment, said process being characterized by the combination in cooperation relationship of:

(i) continuously casting a thin slab of the following composition: 2 to 5.5 wt % Si, 0.05 to 0.4 wt % Mn, <250 ppm (S+5.04 Se), 30 to 130 ppm N, 0.05 to 0.35 wt % Cu, 15 to 300 ppm C, and 200 to 400 ppm Al, remaining being iron and minor impurities, and having a thickness of between 40 and 70 mm, preferably of between 50 and 60 mm, with a casting speed of 3 to 5 m/min, a steel overheating at the casting lesser than 30° C., preferably lesser than 20° C., such a cooling speed as to obtain a complete solidification between 30 to 100 s, preferably between 30 and 60 s, a mould oscillation amplitude of between 1 and 10 mm, and an oscillation frequency of between 200 ans 400 cycles per minute;

(ii) equalizing the thus obtained slabs and hot rolling them, after which the strip cooling is delayed for at least 5 seconds after the strip leaves the last rolling stand;

(iii) directly sending the strip to the cold rolling, avoiding the usual annealing step;

(iv) cold rolling in a single step or in a plurality of steps if necessary with intermediate annealing, with a reduction ratio in the last step of at least 80%, and maintaining a rolling temperature of at least 200° C. in at least two rolling passes during the last step;

(v) continuously annealing the cold rolled strip for a total time of 100 to 350 s, at a temperature comprised between 850 and 1050° C. in a wet nitrogen/hydrogen atmosphere, with a $pH_2O/pH_2$ comprised between 0.3 and 0.7;

(vi) coating the strip with annealing separator, coiling it and box annealing the coils in an atmosphere having the following compositions during the heating-up: hydrogen mixed with at least 30% vol nitrogen up to 900° C., hydrogen mixed with at least 40% vol nitrogen up to 1100–1200° C., then maintaining the coils at this temperature in pure hydrogen.

In the hot rolling, the slabs are treated with a rolling starting temperature of 1000 to 1200° C. and a finishing temperature of 850 to 1050° C.

The steel composition can be different from the conventional one, in that very low carbon contents can be contemplated, between 15 and 100 ppm.

There can also be a copper content of between 800 and 2000 ppm. During the continuous casting, the casting parameters are chosen to obtain an equiaxic to columnar grain ratio of between 35 and 75%, equiaxic grain dimensions less than 1.5 mm, and mean second phase dimensions not greater than 0.06 micrometers.

Such an intermediate product is of paramount importance for a trouble-free development of the remaining of the process and for the final product quality.

If during the decarburization annealing the temperature is maintained below 950° C., the nitrogen content in the atmosphere of the subsequent box-annealing can be so controlled as to allow a nitrogen quantity lesser than 50 ppm to diffuse into the strip.

Such nitrogen absorption can also be obtained in the continuous furnace, after the decarburization annealing, maintaining the strip at a temperature comprised between 900 and 1050° C., preferably over 1000° C., in a nitriding atmosphere, e.g. containing $NH_3$ up to 10% volume. In this case water vapour must be present in a quantity comprised between 0.5 and 100 g/m$^3$.

The above steps of the process can be interpreted as follows:

The steel treatments after the slab formation as well as the results obtainable with such treatments strongly depend on the way in which the steel solidifies, the type and dimensions of the steel grains as well as distribution and dimensions of non-metallic precipitates. For instance, very slow cooling rates enhance the segregation of the elements more soluble in molten iron than in solidified iron, establishing concentration gradients for such elements, and the formation of coarse and not well distributed non-metallic precipitates which adversely influence the final properties of the electrical steel sheet.

The thin slab continuous casting conditions are selected to obtain a number of equiaxial grains higher than the one (usually around 25%) obtainable in the traditional continuous casting (slab thickness around 200–250 mm) as well as crystal dimensions and distributed precipitates particularly apt to obtaining a high quality end product. In particular, the high aluminum content, the fine dimensions of the precipitates and the thin slab annealing at a temperature of 1300° result in aluminum nitride precipitates for controlling grain dimensions in the hot-rolled strip.

In this same sense must be considered the possibility to utilize very low carbon contents, preferably lower than the ones necessary to form a gamma phase, to limit the dissolution of aluminum nitride, much less soluble in the alpha phase than in the gamma one.

The presence of relatively fine aluminum nitride precipitates during the slab formation renders the subsequent thermal treatments less critical; especially the risk of uncontrolled grain growth due to elevations of the decarburization temperature. In a subsequent step, it is possible to obtain a high temperature absorption of nitrogen and greater nitrogen diffusion throughout the strip as well as the direct formation in this step of aluminum nitride.

The formation of a given amount of aluminum nitride enhances the inhibiting effect on grain growth and consequently the quality of the final product. This allows consistency in producing higher quality products.

BRIEF DESCRIPTION OF THE DRAWINGS

The process according to the present invention will now be described in an exemplary and non-limiting way in the Drawings, in which.

Figure 1:
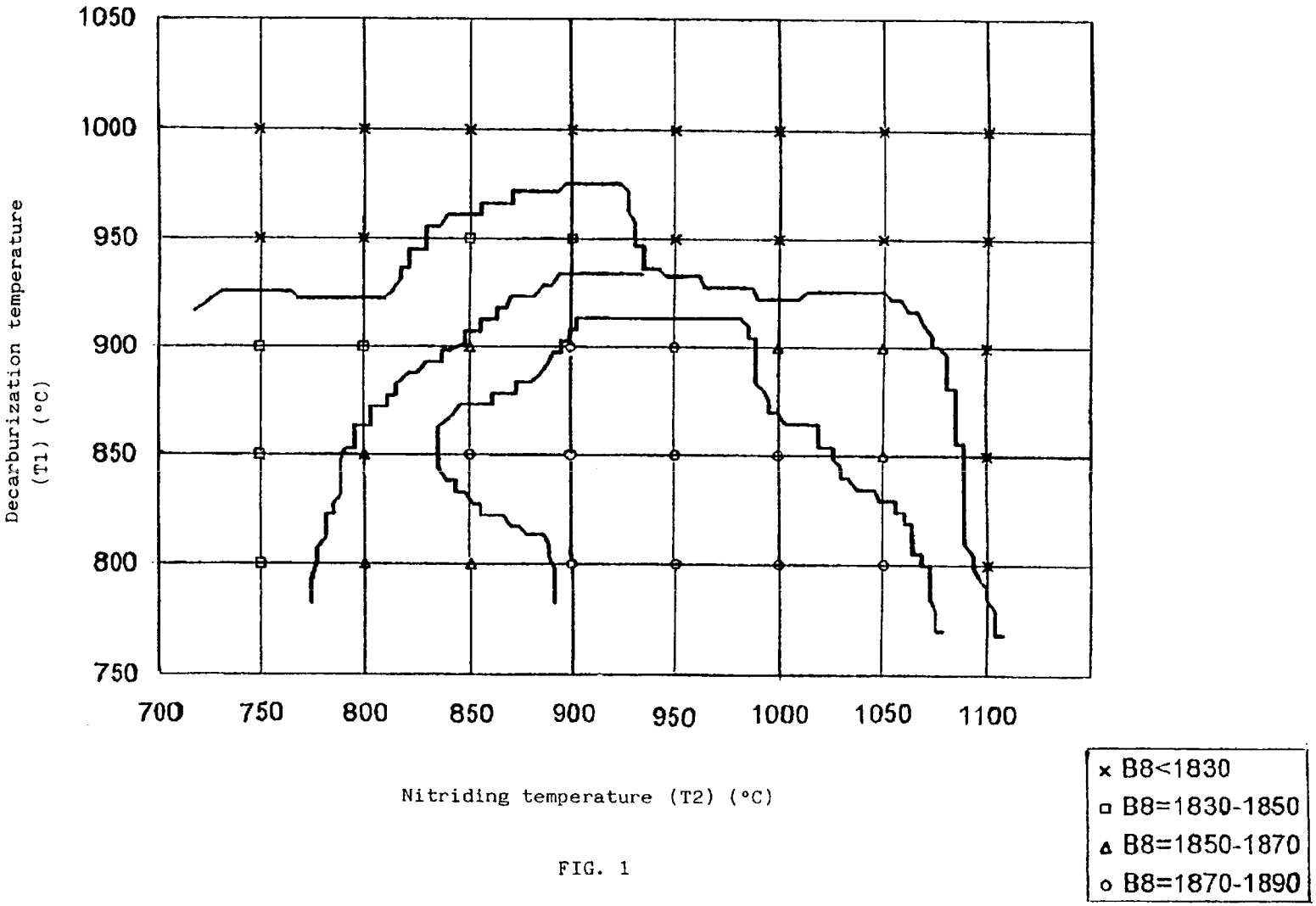
FIG. 1 is a diagram of the B800 values obtained according to Example 2, without addition of ammonia.
Figure 2:
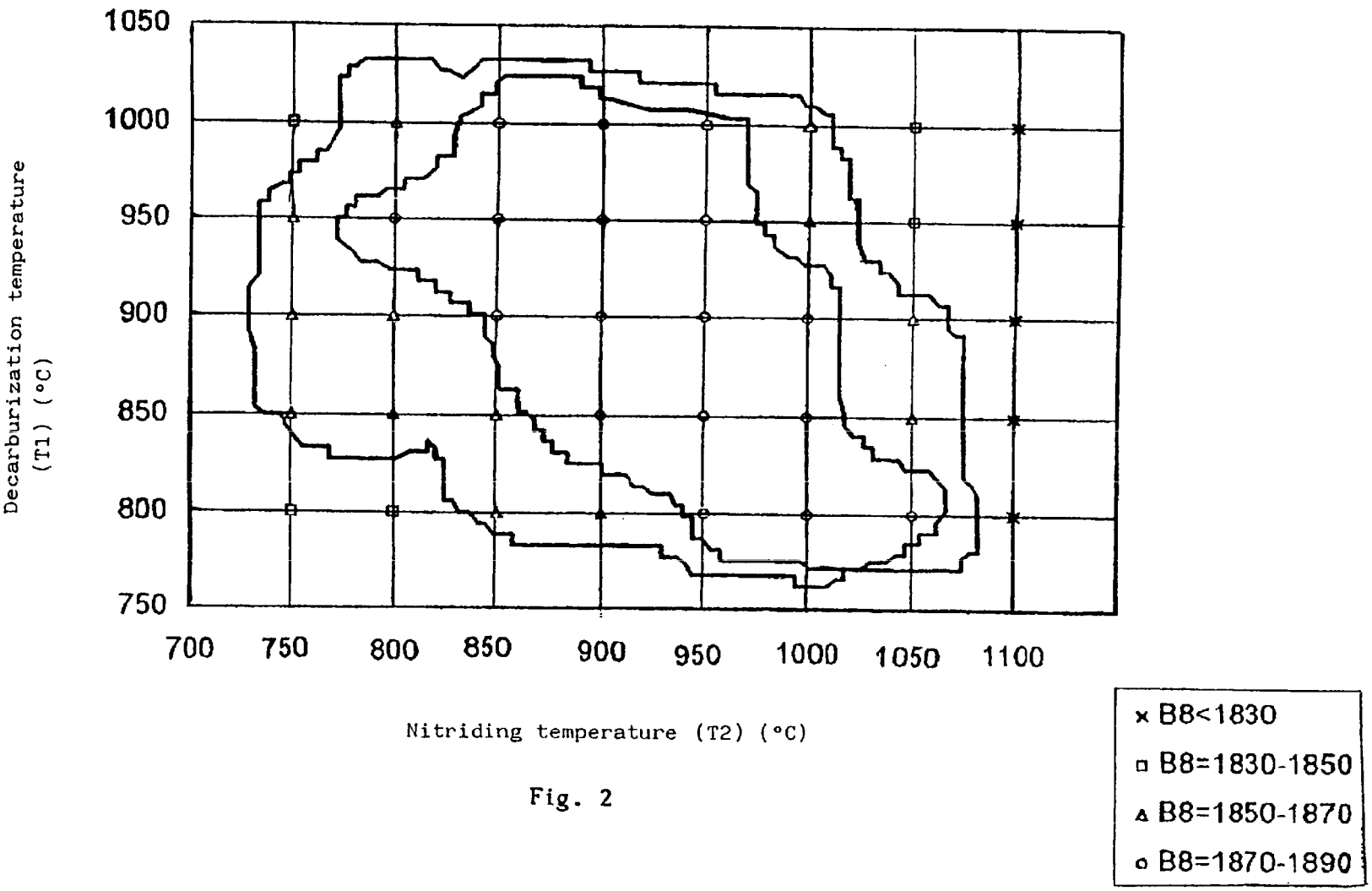
FIG. 2 is a diagram of the B800 values obtained according to Example 2, with a 3% vol ammonia addition.
Figure 3:
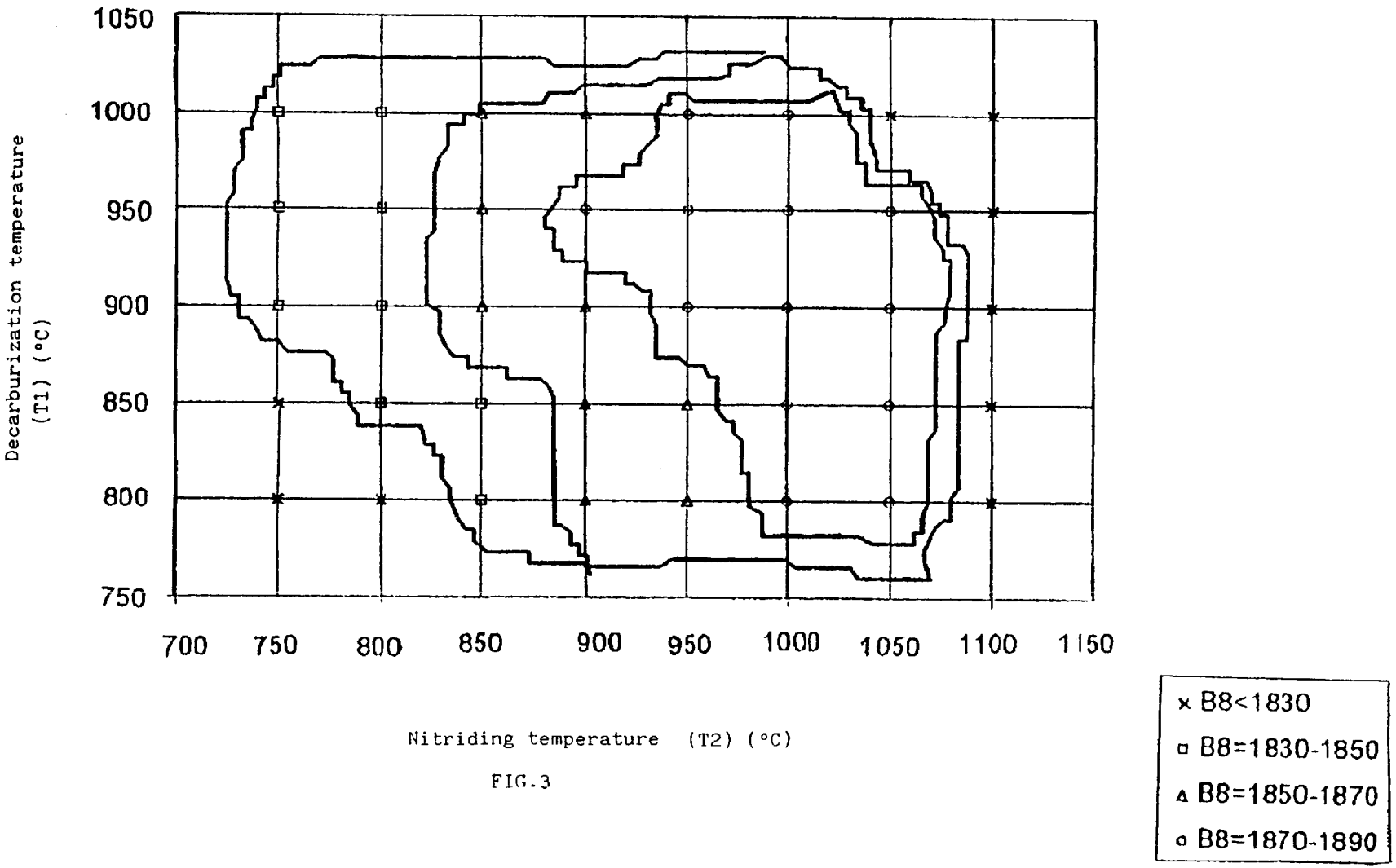
FIG. 3 is a diagram of the B800 values obtained according to Example 2, with a 10% vol ammonia addition.

The present invention will now be illustrated in a number of examples, which, however, are mere illustrations and do not limit the possibilities and range of application of the invention itself.

EXAMPLE 1

A number of steels were produced, whose composition are shown in Table 1:

TABLE 1

| Type | Si % | C ppm | Mn % | Cu % | S ppm | $Al_s$ ppm | N ppm |
|---|---|---|---|---|---|---|---|
| A | 3.15 | 20 | 0.10 | 0.17 | 80 | 300 | 40 |
| B | 3.20 | 100 | 0.13 | 0.18 | 70 | 260 | 90 |
| C | 3.20 | 250 | 0.09 | 0.10 | 60 | 320 | 80 |
| D | 3.15 | 120 | 0.10 | 0.15 | 70 | 280 | 80 |

Types A, B and C were continuously cast in thin slabs 50 mm thick, with a casting speed of 4.8 m/min, a solidification time of 60 s, an overheating temperature of 32° C., in a mould oscillating at 260 cycles/min, with oscillation amplitude of 3 mm, obtaining an equiaxic to columnar grains ratio of 59%. The mean dimension of the equiaxic grains was of 1.05 mm. The mean dimension of precipitates (second phases) was of 0.04 micrometers.

Steel D was continuously cast at a thickness of 240 mm, obtaining an equiaxic to columnar grains ratio of 23%.

All the slabs were equalized at 123° C. for 20 min and hot rolled, without prerolling, at a final thickness of 2.1 mm; some strips were cooled immediately after the las rolling stand, while for all the others the cooling started 7 s after the strip leaving the last rolling stand. No hot rolled strip was annealed.

The strips were then cold rolled in a single stage at a final thickness of 0.29 mm, with five rolling passes, with a rolling temperature at the third and fourth passes of 210° C.

The cold rolled strips were continuously annealed according to the following scheme: decarburization at 870° C. for 60 s in a wet atmosphere having a $pH_2O/pH_2$ of 0.50, and second annealing step at 900° C. for 10 s in a hydrogen-nitrogen (75:25) atmosphere with $pH_2O/pH_2$ of 0.03.

The strips were then coated with a conventional MgO based annealing separator, and box annealed according to the following scheme: quick heating up to 650° C., stop at this temperature for 10 h, heating to 1200° C. at 30° C./h in $H_2$—$N_2$ (70:30) atmosphere, stop at this temperature for 20 h in hydrogen.

After the usual final treatments, the magnetic characteristics were measured and are shown in Table 2:

TABLE 2

| | Delayed cooling according to the invention | | Immediate cooling | |
|---|---|---|---|---|
| Type | B800 (mT) | P17 (w/kg) | B800 (mT) | P17 (w/kg) |
| A | 1880 | 1.09 | 1870 | 1.16 |
| B | 1850 | 1.23 | 1830 | 1.37 |
| C | 1890 | 1.03 | 1870 | 1.19 |
| D | 1520 | 2.35 | 1530 | 2.48 |

EXAMPLE 2

A steel whose composition is shown in Table 3 was continuously cast in thin slabs and transformed in cold rolled strip 0.29 mm thick, as per Example 1.

TABLE 3

| Si % | C ppm | Mn % | Cu % | S ppm | $Al_s$ ppm | N ppm |
|---|---|---|---|---|---|---|
| 3.10 | 50 | 0.08 | 0.10 | 100 | 320 | 75 |

Three strips were continuously annealed according to different cycles: decarburization at T1 ° C. in $H_2$—$N_2$ (75:25) atmosphere with a $pH_2O/pH_2$ of 0.45; heating at T2 ° C. in $H_2$—$N_2$ (75:25) with X % $NH_3$ and a $pH_2O/pH_2$ of 0.03.

The thus obtained strips, utilizing three different X values, were box-annealed as per Example 1.

For each X value different values of T1 and T2 were utilized; the strips were finished as per Example 1 and the obtained magnetic characteristics were measured; the results are shown in the diagrams of the enclosed drawings in which it can be seen that, introduction of ammonia in the terminal part of the continuous furnace makes it possible to considerably expand the T1 and T2 temperature fields, and produce a better product. The criticality of the control of the temperature is reduced and the strip quality stability is improved.

What is claimed is:

1. A process for the production of silicon steel strip, in which a silicon steel is continuously cast, high temperature annealed, hot rolled, cold rolled in a single step or in a plurality of steps with intermediate annealings to form a cold rolled strip; continuously treating the cold rolled strip to obtain primary annealing and decarburization; coated with annealing separator and box annealed to attain final secondary recrystallization, said process being characterized by the following steps:

(i) continuous casting a thin slab of the following composition: 2 to 5.5 wt % Si, 0.05 to 0.4 wt % Mn, <250 ppm (S+(5.04× Se)), 30 to 130 ppm N, 0.05 to 0.35 wt % Cu, 15 to 300 ppm C, and 200 to 400 ppm Al, the remainder being iron and minor impurities, and having a thickness between 40 and 70 mm, utilizing a) a casting speed of 3 to 5 m/min, b) a steel temperature during the casting of less than 30° C. higher than the liquidus temperature of the steel, c) a cooling speed so as to obtain a complete solidification within 30 to 100 s, d) a mold oscillation amplitude between 1 and 10 mm, and e) an oscillation frequency between 200 and 400 cycles per minute;

(ii) equalizing the thus obtained slabs and hot rolling them, after which the strip cooling is delayed for at least 5 seconds after the strip leaves the last rolling stand;

(iii) directly sending the strip to the cold rolling, avoiding the usual annealing step;

(iv) cold rolling in a single step or a plurality of steps, if necessary, with intermediate annealing, with a reduction ratio in the last step of at least 80%;

(v) continuously annealing the cold rolled strip for decarburization and primary recrystallization, for a total time of 100 to 350 s, at a temperature comprised between 850 and 1050° C. in a wet nitrogen/hydrogen atmosphere, with a $pH_2O/pH_2$ comprised between 0.3 and 0.7;

(vi) coating the strip with annealing separator, coiling it and box annealing the coils in an atmosphere having the following compositions during the heating-up: a) hydrogen mixed with at least 30% vol nitrogen up to 900° C., b) hydrogen mixed with at least 40% vol nitrogen up to 1100–12020 C. and c) and thereafter maintaining the coils at this temperature in pure hydrogen.

2. A process according to claim 1, in which the continuous casting parameters are chosen to provide a number of equiaxed grains to the number of columnar grains ratio between 35 and 75%.

3. A process according to claim 1, in which the equiaxed to columnar grains ratio is greater than 50%.

4. A process according to claim 1, in which the equiaxed grain dimensions are less than 1.5 mm %.

5. A process according to claim 1, in which the process parameters during casting and subsequent cooling of thin slab are chosen to obtain precipitation in the slab of fine and uniformly distributed grain growth inhibitor particles.

6. A process according to claim 1, in which during decarburization annealing the temperature is maintained below 950° C., the nitrogen content in the atmosphere of the subsequent box annealing being so controlled as to allow a nitrogen quantity less than 50 ppm to diffuse into the strip.

7. A process according to claim 5, in which after the decarburization annealing, the strip is continuously treated at a temperature comprised between 900 and 1050° C., in a nitriding atmosphere.

8. A process according to claim 7, in which the grain growth inhibitors precipitates dimension are less than 0.06 micrometers.

9. A process according to claim 7, in which the nitriding atmosphere contains $NH_3$ up to 10% volume, and water vapor in a quantity comprised between 0.5 and 100 $g/m^3$.

10. The process as in claim 1, wherein said thin slab has a thickness of between 50 and 60 mm.

11. The process as in claim 1, wherein the steel temperature during the casting is less than 20° C. higher than the liquidus temperature of the steel.

12. The process as in claim 1, wherein said cooling speed at the casting to obtain complete solidification is 30 to 60 s.

13. A process according to claim 1, in which during the hot rolling, the slabs are treated with a rolling start temperature of 1000 to 1200°, and a finishing temperature of 850 to 1050° C.

14. A process according to claim 1, in which the carbon content of the steel is between 15 and 100 ppm.

15. A process according to claim 1, in which the steel has a copper content of between 800 and 2000 ppm.

16. A process according to claim 1, in which during the last cold rolling step a temperature of at least 200° C. is maintained in at least two rolling passes.

* * * * *